US012710222B2

(12) United States Patent
Dong et al.

(10) Patent No.: US 12,710,222 B2
(45) Date of Patent: Aug. 18, 2026

(54) REFRIGERATOR WITH A RESERVED INSTALLATION SPACE ARRANGED AT THE BOTTOM HEAT DISSIPATION COMPARTMENT

(71) Applicants: QINGDAO HAIER REFRIGERATOR CO., LTD., Qingdao (CN); HAIER SMART HOME CO., LTD., Qingdao (CN)

(72) Inventors: Lingyun Dong, Qingdao (CN); Bin Fei, Qingdao (CN); Changzhi Wang, Qingdao (CN); Jianquan Chen, Qingdao (CN)

(73) Assignees: QINGDAO HAIER REFRIGERATOR CO., LTD., Qingdao (CN); HAIER SMART HOME CO., LTD., Qingdao (CN)

( * ) Notice: Subject to any disclaimer, the term of this patent is extended or adjusted under 35 U.S.C. 154(b) by 142 days.

(21) Appl. No.: 18/701,516

(22) PCT Filed: Jul. 28, 2022

(86) PCT No.: PCT/CN2022/108724
§ 371 (c)(1),
(2) Date: Apr. 15, 2024

(87) PCT Pub. No.: WO2023/065761
PCT Pub. Date: Apr. 27, 2023

(65) Prior Publication Data

US 2025/0003673 A1 Jan. 2, 2025

(30) Foreign Application Priority Data

Oct. 18, 2021 (CN) ..... 202111209888.6

(51) Int. Cl.
*F25D 23/12* (2006.01)
*F25D 21/14* (2006.01)
*F25D 23/00* (2006.01)

(52) U.S. Cl.
CPC ..... *F25D 23/12* (2013.01); *F25D 21/14* (2013.01); *F25D 23/006* (2013.01)

(58) Field of Classification Search
CPC ..... F25D 23/12; F25D 21/14; F25D 23/006; F25D 19/00; F25D 2321/1412
See application file for complete search history.

(56) References Cited

U.S. PATENT DOCUMENTS 5,953,929 A * 9/1999 Bauman ..... F25D 21/14 62/448
2012/0017623 A1* 1/2012 Yoon ..... F25D 21/04 62/288
2016/0069595 A1 3/2016 Kim et al.

FOREIGN PATENT DOCUMENTS

CN 1629568 A 6/2005
CN 110375486 A * 10/2019 ..... F25D 29/003
(Continued)

OTHER PUBLICATIONS

KR-20190087396-A Translation (Year: 2019).*
CN-110375486-A Translation (Year: 2018).*

*Primary Examiner* — David J Teitelbaum
(74) *Attorney, Agent, or Firm* — MUNCY, GEISSLER, OLDS & LOWE, P.C.

(57) ABSTRACT

A refrigerator with a reserved installation space arranged in a bottom heat dissipation compartment includes a cabinet with a heat dissipation compartment set at its rear bottom; a compressor, a duct assembly, and an evaporating tray sequentially arranged within the heat dissipation compartment along a horizontal direction of the cabinet, and the heat dissipation compartment reserves an installation space on
(Continued)

one side away from the duct assembly relative to the evaporating tray, the installation space is equipped with one or more mating structures, each of which is used to install an auxiliary functional component. This design optimizes the layout of devices within the confined space of the heat dissipation compartment to fulfill the purpose of reserving installation space. This provides installation space for expanding the functionality of different refrigerator models, enhancing product competitiveness and saving development costs.

17 Claims, 7 Drawing Sheets

(56) References Cited

FOREIGN PATENT DOCUMENTS

| | | | | | |
|---|---|---|---|---|---|
| CN | 111609632 | A | | 9/2020 | |
| CN | 112444094 | A | | 3/2021 | |
| CN | 113154765 | A | | 7/2021 | |
| JP | 2004150763 | A | | 5/2004 | |
| JP | 2014048029 | A | | 3/2014 | |
| JP | 2014052094 | A | | 3/2014 | |
| JP | 2018004183 | A | | 1/2018 | |
| JP | 2020122636 | A | | 8/2020 | |
| KR | 20190087396 | A | * | 7/2019 | ..... F25D 23/006 |
| KR | 20190142994 | A | | 12/2019 | |

* cited by examiner

REFRIGERATOR WITH A RESERVED INSTALLATION SPACE ARRANGED AT THE BOTTOM HEAT DISSIPATION COMPARTMENT

This application is a National Phase conversion of International (PCT) Patent Application No. PCT/CN2022/108724, filed on Jul. 28, 2022, which claims priority to Chinese Patent Application No. 202111209888.6, entitled "Refrigerator with A Reserved Space Arranged at The Bottom Heat Dissipation Compartment", filed on Oct. 18, 2021, the disclosure of which is incorporated herein by reference in its entirety.

TECHNICAL FIELD

Present application belongs to the technical field of refrigeration equipment, specifically providing a refrigerator with reserved installation space arranged in the bottom heat dissipation compartment.

BACKGROUND

In the existing technology, some refrigerators, especially built-in refrigerators, arrange the condenser, compressor, and evaporating tray within a heat dissipation compartment at the bottom of the cabinet. A heat dissipating fan draws ambient air from outside the refrigerator and facilitates air circulation within the heat dissipation compartment for convective cooling of the condenser and compressor.

Since refrigerator products are marketed in series, each series may be divided into several models ranging from high to low end, with most of main functional components being common across different models. However, there might be differences in functional configurations among some mid to high-end models. By differentiating functions, the competitiveness and selling points of refrigerator products are enhanced.

To maintain a cost advantage while maximizing product competitiveness, refrigerators in the aforementioned series typically reserve space and environment interfaces for high-end models that may be used in the basic model. This allows for the addition of auxiliary functional components without the need for significant changes to the overall product model.

Some auxiliary functional components need to be placed outside the insulation layer, where the heat dissipation compartment of the compressor (also known as a compressor compartment or a compressor chamber) is a commonly used location. However, due to the numerous components already present in the heat dissipation compartment, it presents a significant technical challenge to arrange the required installation space without affecting heat radiating efficiency.

Reference to any prior art in the specification is not, and should not be take n as, an acknowledgment or any form of suggestion that this prior art forms part of the common general knowledge in Europe or any other jurisdiction or that this prior art could reasonably be expected to be understood and regarded as relevant by a person skilled in the art.

SUMMARY

One objective of present application is to provide a refrigerator having a reserved installation space in the heat dissipation compartment.

Another further objective is to enhance the flexibility of auxiliary function configuration of a refrigerator model.

To achieve the mentioned objectives, present application offers a refrigerator with a reserved installation space arranged in a bottom heat dissipation compartment. The refrigerator includes:

a cabinet defining a storage chamber, with a heat dissipation compartment set at its rear bottom;

a compressor, a duct assembly, and an evaporating tray sequentially arranged within the heat dissipation compartment along a horizontal direction of the cabinet, wherein a heat dissipating fan is installed on one side of the duct assembly facing the compressor, a condenser is installed on one side of the duct assembly facing the evaporating tray, and the heat dissipation compartment reserves an installation space on one side away from the duct assembly relative to the evaporating tray, the installation space is equipped with one or more mating structures, each of which is used to install an auxiliary functional component.

Optionally, a length of the installation space along the horizontal direction of the refrigerator is greater than or equal to 10% of a length of the heat dissipation compartment along the horizontal direction of the refrigerator.

Optionally, the mating structures include a first mating structure set on a bottom plate of the installation space and a second mating structure set on a sidewall of the installation space opposite the duct assembly.

Optionally, a bottom plate of the heat dissipation compartment on one side opposite the compressor relative to the duct assembly is equipped with a first roller; the bottom plate of the installation space is equipped with a second roller; the first mating structure surrounds the second roller.

Optionally, the first mating structure includes multiple fixing holes and fixing columns corresponding one-to-one with the fixing holes; and an auxiliary functional component mounted on the first mating structure includes a vacuum pump, which is mounted on the fixing columns.

Optionally, heights of the fixing columns are configured such that a first height from a bottom of the second roller to the bottom plate of the heat dissipation compartment is less than a second height from a top of the second roller to a bottom of the vacuum pump.

Optionally, a top of the vacuum pump is spaced at a gap from a top wall of the installation space, and a front wall of the installation space opposite to a front end of the top of the vacuum pump forms a clearance greater than a preset value at by pressing.

Optionally, a horizontal distance from the evaporating tray to a side wall of the vacuum pump is less than a horizontal distance from the vacuum pump to the sidewall of the installation space.

Optionally, the second mating structure includes a positioning slot and fixing holes located on the sidewall of the installation space;

an auxiliary functional component mounted on the second mating structure includes an ice water valve, which is connected to the second mating structure through a fixed frame.

Optionally, the fixed frame is configured to position the ice water valve in a center of the installation space, maintaining specified distances from the sidewall, top wall, bottom wall of the installation space, and the evaporating tray.

Based on the description above, a person skilled in the art can understand that, in the technical solution of present application, the heat dissipation compartment reserves an installation space on the side of the evaporating tray away from the duct assembly, and the installation space is equipped with one or more mating structures, each for installing an auxiliary functional component. By optimizing the layout within the confined space of the heat dissipation compartment, the purpose of reserving the installation space is achieved. This provides installation space for expanding the functionality of different refrigerator models, enhancing product competitiveness and saving development costs.

Furthermore, the refrigerator of present application precisely designs the dimensions of the installation space and its relative position to surrounding components to avoid structural interference, making full use of the space in the heat dissipation compartment without affecting heat dissipation efficiency.

Furthermore, the refrigerator of present application optimizes the layout of components such as the compressor, fan, condenser, and evaporating tray within the heat dissipation compartment, maintaining a compact structure and efficient space utilization.

As used herein, except where the context clearly requires otherwise, the ter m "include" and variations of the term, such as "including", "includes" and "included", are not intended to exclude further features, components, integers or steps.

Following the detailed description of specific embodiments of present application in conjunction with the accompanying drawings below, a person skilled in the art will better understand the above and other objectives, advantages, and features of present application.

BRIEF DESCRIPTION OF DRAWINGS

To clearly illustrate the technical solutions of present application, the following description refers to drawings of some embodiments of present application. It should be understood by a person skilled in the art that the same reference numerals in different drawings denote identical or similar parts or sections; the drawings of present application are not necessarily drawn to scale. In the drawings.

DETAILED DESCRIPTION OF EMBODIMENTS

Figure 1:
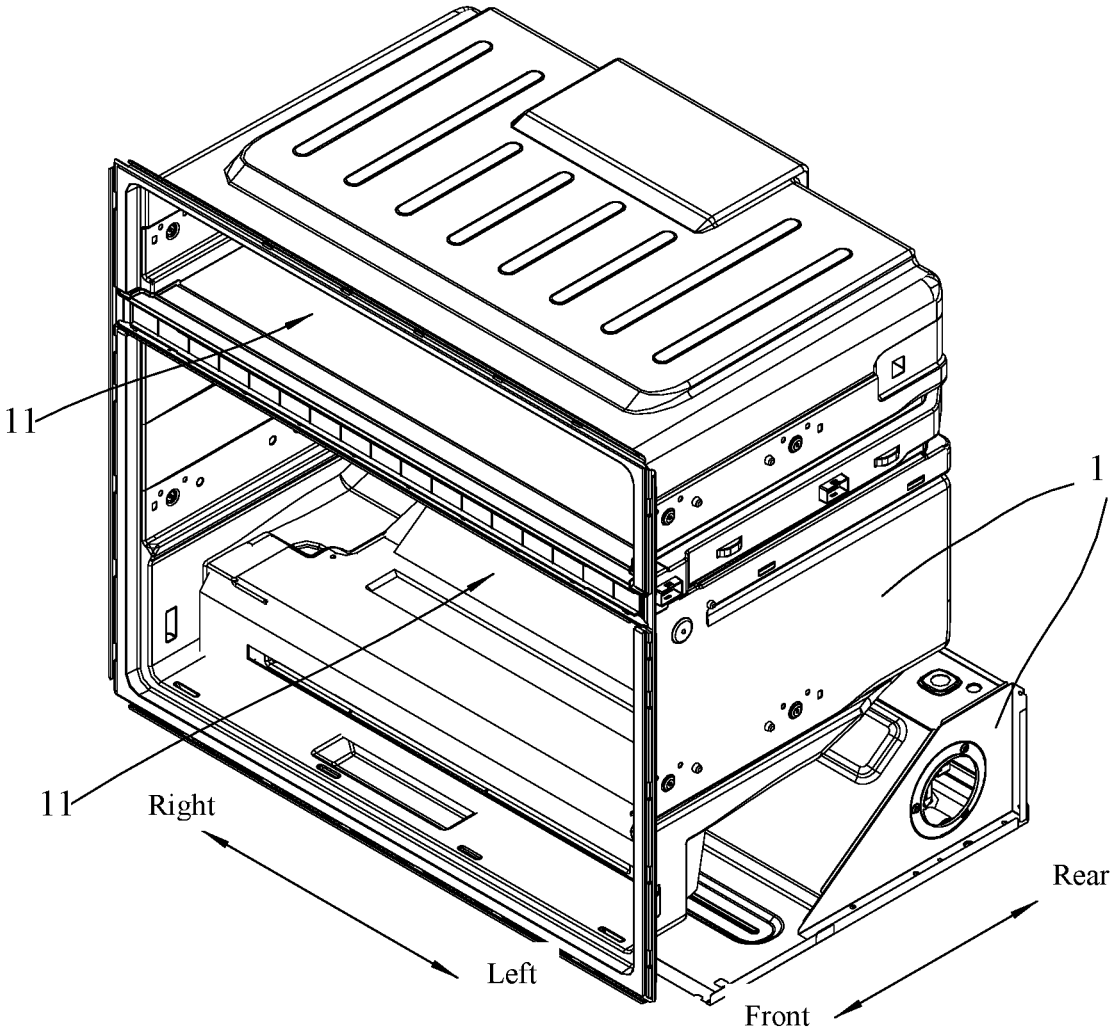
FIG. 1 is a front upper axonometric view of a local structure at a bottom of a refrigerator with a reserved installation space arranged in a bottom heat dissipation compartment, according to some embodiments of present application.

It should be understood by a person skilled in the art that the embodiments described below are only part of the embodiments of present invention, and not all embodiments of present invention. These embodiments are intended to explain the technical principles of present application and are not intended to limit the scope of protection of present application. Based on the embodiments provided by present application, all other embodiments obtained by a person of ordinary skill in the art without creative efforts should fall within the protection scope of present application.

It should be noted that in the description of present application, terms indicating direction or positional relationships such as "center," "up." "down," "top." "bottom," "left," "right," "vertical," "horizontal," "inner," and "outer" are based on the directions or positional relationships shown in the drawings, merely for the sake of description, and do not indicate or imply that the device or element must have a specific orientation, be constructed and operated in a specific orientation, and thus should not be understood as limiting present application. Furthermore, terms like "first," "second," and "third" are used only for descriptive purposes and should not be understood as indicating or implying relative importance.

Moreover, it should also be explained that, in the description of present application, unless otherwise specified and defined, terms "installing", "connecting", and "linking" should be broadly understood. For instance, they can be fixed connections, detachable connections, or integrated connections; mechanical connections or electrical connections; direct connections or indirect connections through intermediate media, or internal connections of two elements. A person skilled in the art can understand the specific meanings of these terms in present application according to the actual situation.

Figure 2:
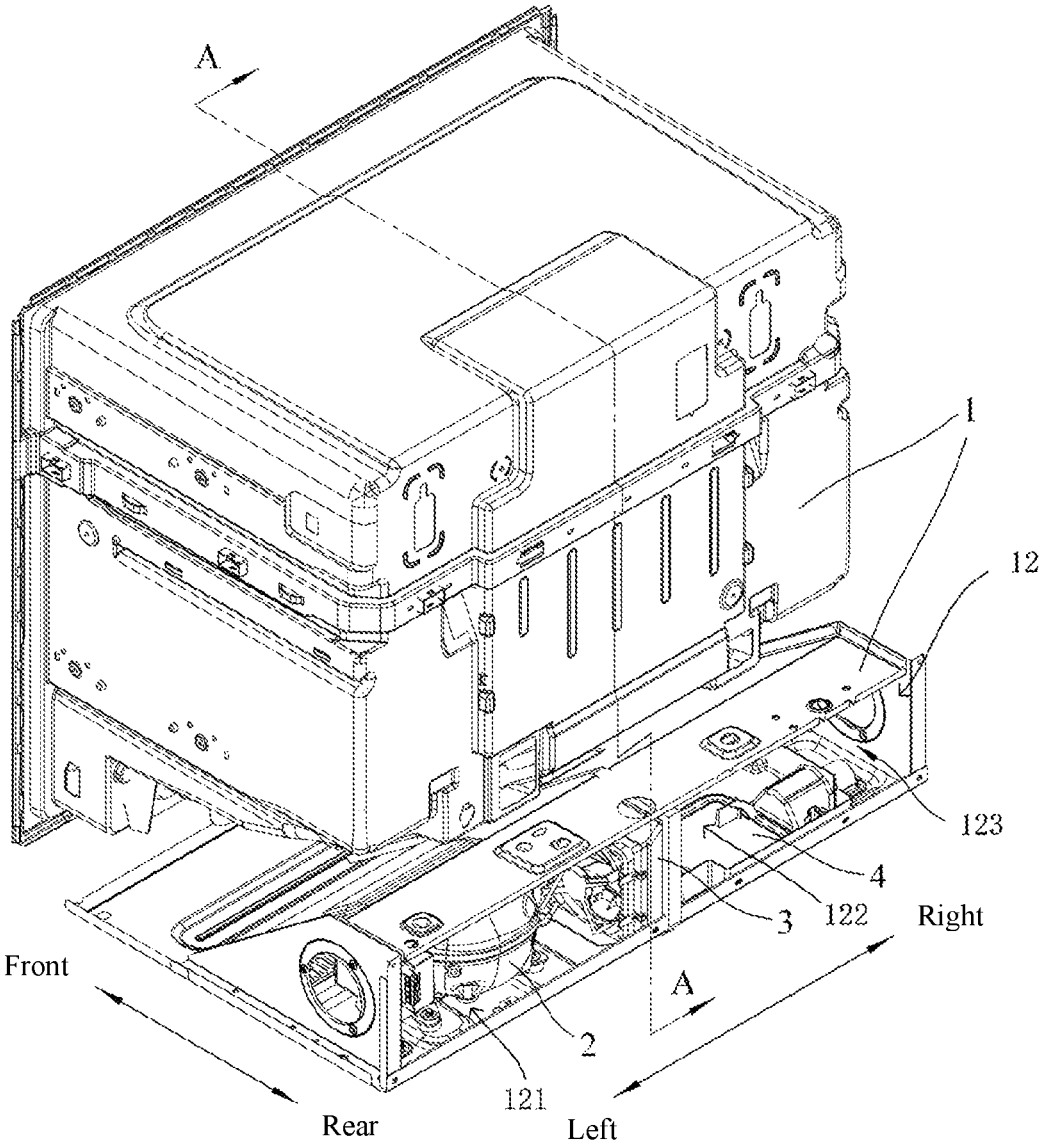
FIG. 2 is a rear upper axonometric view of a local structure at the bottom shown in FIG. 1.
Figure 3:
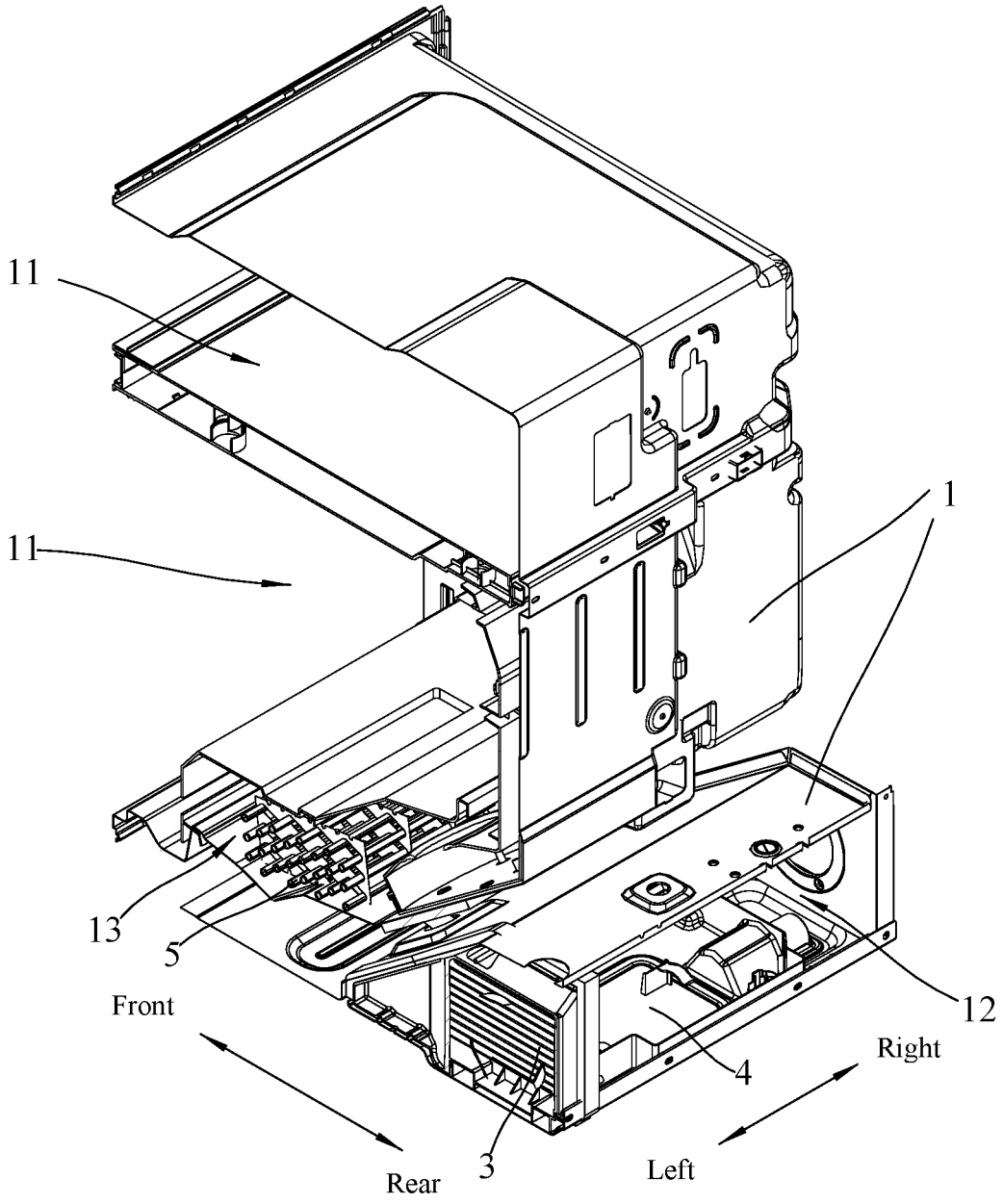
FIG. 3 is a cross-sectional view along an A-A direction of a local structure at the bottom shown in FIG. 2.

FIG. 1 is a front upper axonometric view of a local structure at a bottom of a refrigerator with a heat dissipation compartment set at the bottom according to some embodiments of present application; FIG. 2 is a rear upper axonometric view of a local structure at the bottom shown in FIG. 1; FIG. 3 is a cross-sectional view along the A-A direction of a local structure at the bottom shown in FIG. 2.

As shown in FIGS. 1 to 3, in some embodiments of present application, a refrigerator mainly includes a cabinet 1, a compressor 2, a duct assembly 3, an evaporating tray 4, and an evaporator 5.

Referring again to FIGS. 1 to 3, the cabinet 1 defines storage chambers 11, a heat dissipation compartment 12, and a refrigeration chamber 13. The storage chambers 11 are not limited to the two shown in FIGS. 1 and 2 but can be configured in other quantities as needed, such as one or more. When there is one storage chamber 11, it can be a freezer, a variable temperature chamber, or a refrigerated chamber. When there are two or more storage chambers 11, the multiple storage chambers 11 include at least one or more of a freezer, a variable temperature chamber, and a refrigerated chamber. In the specific implementation of the technical scheme of this application, a person skilled in the art can configure the number and functions of storage chambers 11 as needed.

Continuing to refer to FIGS. 1 to 3, the cabinet 1 has a heat dissipation compartment 12 at its rear bottom. In some embodiments, a bottom of the storage chamber 11 forms a refrigeration chamber 13 for arranging the evaporator 5. That is, the refrigeration chamber 13 can be set above a front of the heat dissipation compartment 12, thereby achieving a bottom-placed evaporator refrigerator. The refrigeration chamber 13 occupies a bottom area of an inner liner, elevating the storage chamber 11 and reducing a degree of bending for users when placing or retrieving items, thus enhancing the user experience. The evaporator 5 is installed inside the refrigeration chamber 13, providing cooling to the interior of the storage chamber 11.

The heat dissipation compartment 12 is divided by the duct assembly 3 into a first heat dissipation chamber 121 and a second heat dissipation chamber 122, partitioning the space and arranging different components respectively. A right side of the second heat dissipation chamber 122 reserves an installation space 123.

Figure 4:
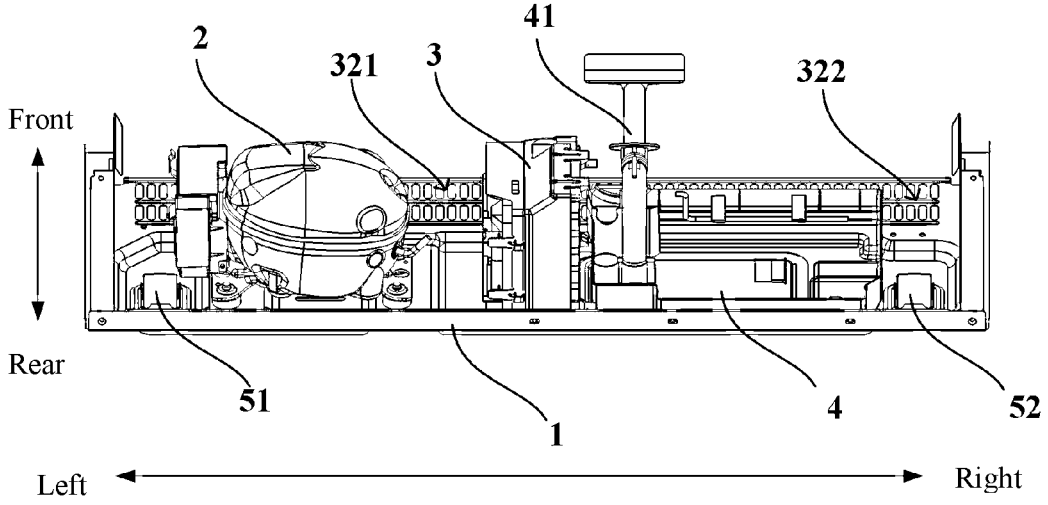
FIG. 4 is a schematic diagram showing a distribution of main components inside the heat dissipation compartment of the refrigerator according to some embodiments of present application.
Figure 5:
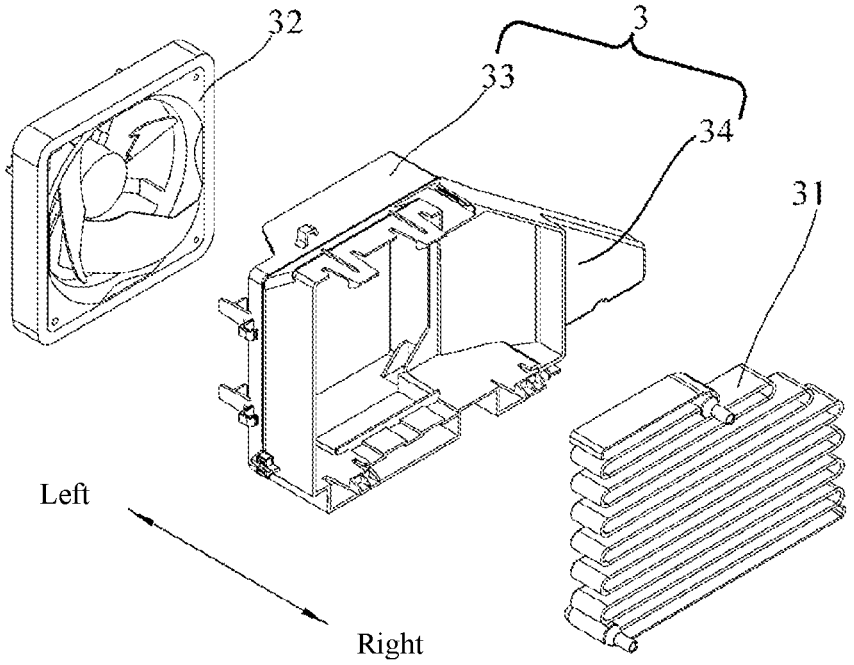
FIG. 5 is an exploded view of a duct assembly with a heat dissipating fan and condenser in the refrigerator according to some embodiments of present application.

FIG. 4 is a schematic diagram showing the main component distribution inside the heat dissipation compartment 12 of the refrigerator according to some embodiments of present application. FIG. 5 is a structural exploded view of the duct assembly 3 with a heat dissipating fan 32 and a condenser 31 in the refrigerator according to some embodiments of present application; from left to right along the horizontal direction of the refrigerator, the compressor 2, the duct assembly 3, and the evaporating tray 4 are sequentially arranged inside the heat dissipation compartment 12. That is, the compressor 2, the duct assembly 3, and the evaporating tray 4 are sequentially set within the heat dissipation compartment 12 along a horizontal direction of the cabinet 1.

The duct assembly 3 is positioned in a middle of the heat dissipation compartment 12, dividing it along the horizontal direction of the cabinet 1 into the first heat dissipation chamber 121 and the second heat dissipation chamber 122. The compressor 2 and the evaporating tray 4 are respectively placed within the first heat dissipation chamber 121 and the second heat dissipation chamber 122. A condenser 31 is installed on a side facing the evaporating tray 4 of the duct assembly 3, and a heat dissipating fan 32 is installed on a side facing the compressor 2 of the duct assembly 3. Thus, the duct assembly 3, along with the heat dissipating fan 32 and condenser 31, form a pre-assembled unit creating a duct structure through which the heat dissipating air flows, ensuring all air passes through the condenser 31. This enhances heat dissipating efficiency while making the structure more compact and simplifying the assembly process.

A fan fixing structure is provided on a side facing the first heat dissipation chamber 121 of the duct assembly 3, and a condenser fixing structure is provided on a side facing the second heat dissipation chamber 122 of the duct assembly 3. The heat dissipating fan 32 is mounted on the fan fixing structure to facilitate the formation of a heat dissipating airflow that enters from outside the cabinet 1, passes through the first and second heat dissipation chambers 121 and 122, and then exits the cabinet 1. The condenser 31 is mounted on the condenser fixing structure and is cooled by the heat dissipating airflow. The airflow sequentially cools the compressor 2, condenser 31, and evaporating tray 4, thereby improving heat dissipating efficiency.

The duct assembly 3 includes a bracket body 33 and a wind deflector 34. The bracket body 33 is square cylindrical in shape and extends along the horizontal direction of the cabinet 1, that is, extends in a left-right direction. The cylindrical shape of the bracket body 33 allows the heat dissipating airflow to pass through. The wind deflector 34 extends from a front end of the bracket body 33 to block a front area of the first and second heat dissipation chambers 121 and 122, thus preventing the heat dissipating airflow from recirculating and allowing the heat dissipating airflow to blow only through the cylinder of the bracket body 33.

The fan fixing structure and the condenser fixing structure can be claw structures, respectively connecting to the heat dissipating fan 32 and the condenser 31, embedding part of the heat dissipating fan 32 and condenser 31 inside the duct assembly 3, which makes the structure more compact. The bracket body 33, being square cylindrical in shape, is assembled on both sides with the heat dissipating fan 32 and condenser 31 through snap-fit structures, ensuring that air flowing into the heat dissipation compartment 12 passes through the condenser 31, cooling it and ensuring the cooling effect of the condenser 31. This structural optimization also provides possibilities for arranging the installation space 123.

The heat dissipating fan 32 preferably uses an axial fan, with an axis extending in the left-right direction, and an airflow direction blowing from the first heat dissipation chamber 121 through the bracket body 33 towards the second heat dissipation chamber 122. The condenser 31 can preferably use a microchannel condenser to save space occupied by the condenser 31, facilitating cooperation with the bracket body 33. The gaps between microchannels of the microchannel condenser align with a direction of the heat dissipating airflow, requiring all the heat dissipating airflow to pass through the condenser 31, thereby improving the heat exchange efficiency.

The duct assembly 3 enhances the heat exchange efficiency of the heat dissipating airflow with the condenser 31, achieving space-saving while satisfying heat dissipating efficiency.

The evaporating tray 4 is installed inside the second heat dissipation chamber 122 to catch water discharged from a drainage tube 41 connected to the refrigeration chamber 13. The drainage tube 41 extends from the refrigeration chamber 13 to the heat dissipation compartment 12, that is, an upper end of the drainage tube 41 is connected to a bottom of the refrigeration chamber 13, and a lower end extends to the evaporating tray 4. The drainage tube 41 is used to discharge defrost water of the refrigerator into the evaporating tray 4, where the water is evaporated into the ambient air.

A bottom plate of the heat dissipation compartment 12 is equipped with a heat dissipating air inlet 321 and a heat dissipating air outlet 322 at a front of the first and second heat dissipation chambers 121 and 122, respectively. The environmental air below the refrigerator enters the heat dissipation compartment 12 through the heat dissipating air inlet 321, first exchanges heat with the compressor 2, then passes through the heat dissipating fan 32 and condenser 31, accelerating the evaporation of water inside the evaporating tray 4, and finally is expelled under the refrigerator through the heat dissipating air outlet 322. The smooth flow of the heat dissipating air improves the heat dissipating efficiency of each component. An isolation piece can further be added on the underside of the refrigerator's bottom plate to separate the heat dissipating air inlet 321 and the heat dissipating air outlet 322, preventing the expelled heat dissipating air from being re-intaken.

The bottom plate of the heat dissipation compartment 12 can also be referred to as a compressor support plate, on whose left and right sides a first roller 51 and a second roller 52 are respectively set. That is, the first roller 51 is set on the bottom plate of the heat dissipation compartment 12 on one side opposite the compressor 2 relative to the duct assembly 3; the second roller 52 is set on the bottom plate of the heat dissipation compartment 12 on one side opposite the evaporating tray 4 relative to the duct assembly 3. The first roller 51 and the second roller 52 facilitate rolling when moving the refrigerator 1. The space above the second roller 52 is designated as the installation space 123, and a relationship between an auxiliary functional component installed within the installation space 123 and the second roller 52 needs optimization to avoid structural interference and impacts during transportation.

Installation space 123 may be equipped with one or more mating structures, each of which is used to install an auxiliary functional component. A length of installation space 123 along the horizontal direction of the refrigerator (i.e., left-right direction) is greater than or equal to 10% of a length of the heat dissipation compartment 12 along the horizontal direction of the refrigerator, ensuring sufficient space for arranging auxiliary functional components.

The mating structures may include a first mating structure set on a bottom plate of installation space 123 and a second mating structure set on a sidewall of installation space 123 opposite the duct assembly 3 (i.e., a right sidewall). The first and second mating structures are used for arranging different auxiliary functional components, and can choose the corresponding auxiliary functional component according to the refrigerator's specification. The first mating structure can surround the second roller 52.

Figure 6:
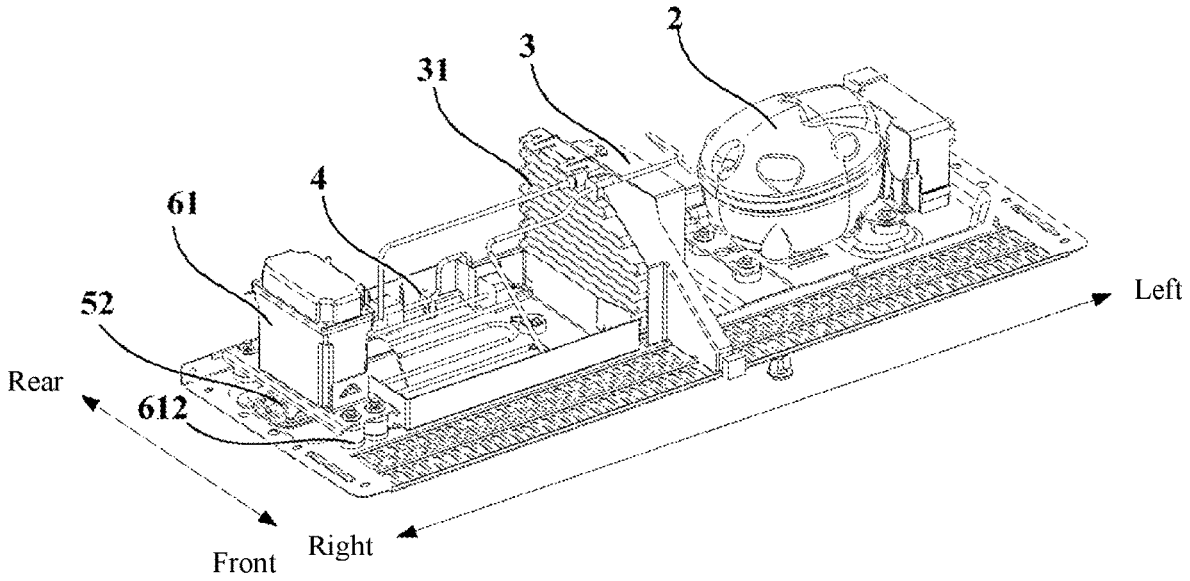
FIG. 6 is a schematic diagram showing an installation of a vacuum pump in the installation space using a first mating structure, according to some embodiments of present application.
Figure 7:
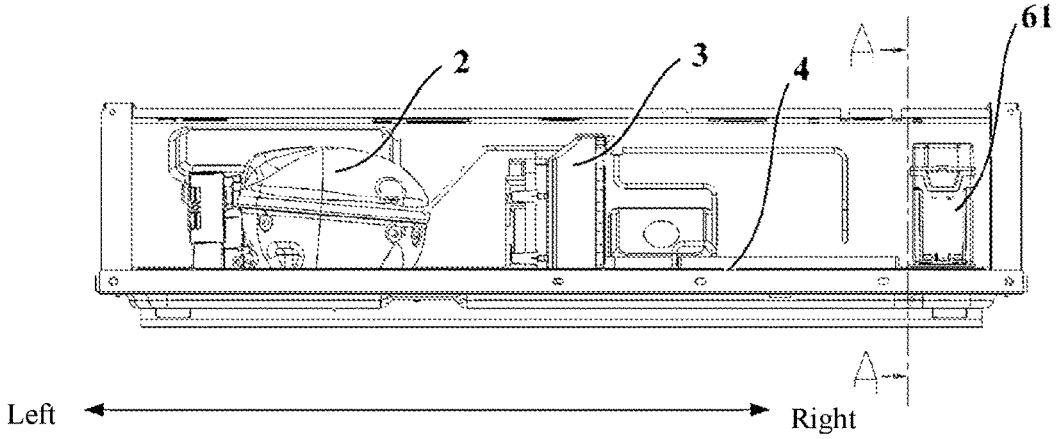
FIG. 7 is a schematic diagram of the structure shown in FIG. 6 from another angle.
Figure 8:
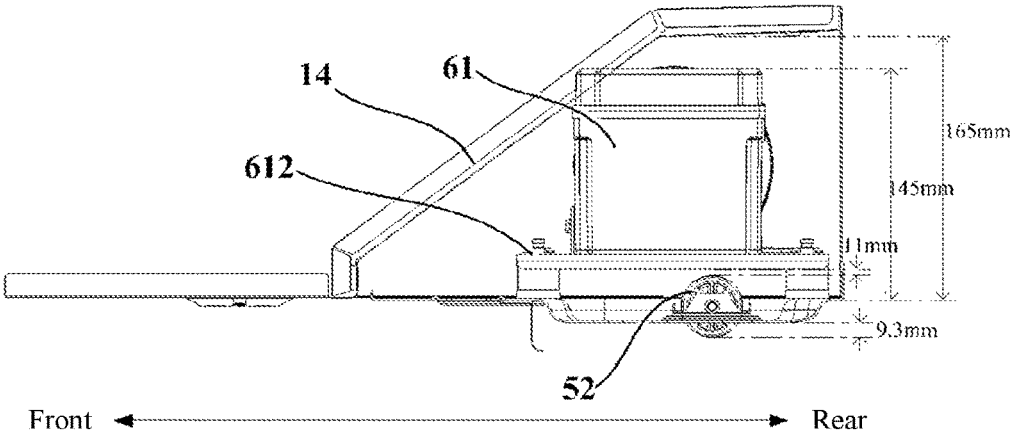
FIG. 8 is a schematic cross-sectional view taken along line A-A in FIG. 7.
Figure 9:
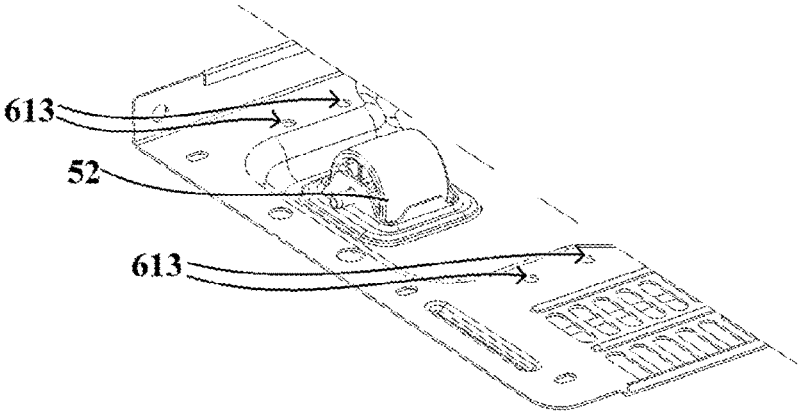
FIG. 9 is a schematic diagram showing a position of a second roller and fixing holes in the refrigerator according to some embodiments of present application.

FIG. 6 is a schematic diagram of a refrigerator according to some embodiments of present application, showing a vacuum pump 61 installed in the installation space 123 using the first mating structure; FIG. 7 is a schematic diagram of the structure shown in FIG. 6 from another angle; FIG. 8 is a schematic cross-sectional view taken along line A-A in FIG. 7. FIG. 9 is a schematic diagram showing the position of the second roller 52 and fixing holes 613 in a refrigerator according to some embodiments of present application.

The first mating structure may include multiple fixing holes 613 and fixing columns 612 set correspondingly one-to-one with the multiple fixing holes 613; and an auxiliary functional component mounted on the first mating structure can be a vacuum pump 61. The vacuum pump 61 is mounted on the fixing columns 612. In some embodiments, the fixing holes 613 can be riveting holes, and bottom ends of the fixing columns 612 are riveted to the fixing holes 613. The vacuum pump 61 is fixed to top of the fixing columns 612 through connecting parts, such as screws, keeping the vacuum pump 61 at a distance from the bottom plate.

Heights of the fixing columns 612 are configured so that a first height from a bottom of the second roller 52 to the bottom plate of the heat dissipation compartment 12 is less than a second height from a top of the second roller 52 to a bottom of the vacuum pump 61. Such a configuration prevents the second roller 52 from hitting the vacuum pump 61 in case of drops during transportation of the refrigerator, potentially preventing a damage of the vacuum pump 61. Even in case of bumps, the second roller 52 can at most be level with the bottom plate, ensuring that there is still some clearance between the vacuum pump 61 and the second roller 52. For example, as shown in FIG. 8, the first height can be 9.3 mm, and the second height can be 11 mm, meaning the distance from the bottom plate of the heat dissipation compartment 12 to the second roller 52 is 9.3 mm, and the distance from the vacuum pump 61 to the second roller 52 is 11 mm. These specific dimension values are just examples, and those skilled in the art can flexibly configure them based on component sizes, refrigerator specifications, etc., such as adjusting proportionally or within a certain range. The specific numeric values mentioned in the description of this embodiment are also examples.

A top of the vacuum pump 61 is spaced at a gap from a top wall of the installation space 123, which can be about 20 mm, and a front wall 14 of the installation space 123 opposite to a front end of the vacuum pump 61 forms a clearance greater than a preset value by pressing, with the preset value being set to 5 mm. The front wall 14 of the installation space 123 (also referred to as the bottom steel plate, forming a bottom of an insulation layer) is inclined to reserve space for the refrigeration chamber 13, which might interfere with the front end of the vacuum pump 61. Therefore, the clearance created by pressing is necessary to buffer and prevent the bottom steel plate 14 from damaging the vacuum pump 61 during falls. The bottom steel plate 14 is generally a sheet metal part, and its pressing for clearance is easy to achieve.

Taking a cabinet with a horizontal width of the bottom plate of heat dissipation compartment 12 being 820 mm as an example, a specific dimension of the installation space is introduced. A horizontal distance between the evaporating tray 4 and the sidewall (right sidewall) of the installation space 123 is only 88 mm, while an own horizontal length of the vacuum pump 61 is 70 mm. A horizontal position of the vacuum pump 61 can be set such that a left side is 8 mm away from the evaporating tray, and a right side is 10 mm away from the right sidewall. Correspondingly, a proportion of the horizontal length of the vacuum pump 61 occupies 79.5% of a total horizontal size of the installation space 123, the distance from the left side of the vacuum pump 61 to the evaporating tray 4 occupies 9.1% of the total horizontal size of the installation space 123, and the distance from the right side of the vacuum pump 61 to the right sidewall occupies 11.4% of the total horizontal size of the installation space 123. That is, a horizontal distance from the evaporating tray 4 to the sidewall of the vacuum pump 61 can be less than a distance from the vacuum pump 61 to the sidewall (right sidewall) of the installation space 123.

The above structural dimensions are the result of extensive calculations, trials, and breakthroughs in the mentioned spatial constraints, after improvements in component layout and verification of matching mechanisms, making it almost the only feasible layout method. Those skilled in the art can flexibly configure specific dimensions based on component sizes, refrigerator specifications, etc., such as adjusting proportionally or within a certain range.

The mentioned vacuum pump 61 can be used for evacuating the storage chamber 11, for example, in combination with a gas modulation module to adjust the atmospheric environment inside.

Figure 10:
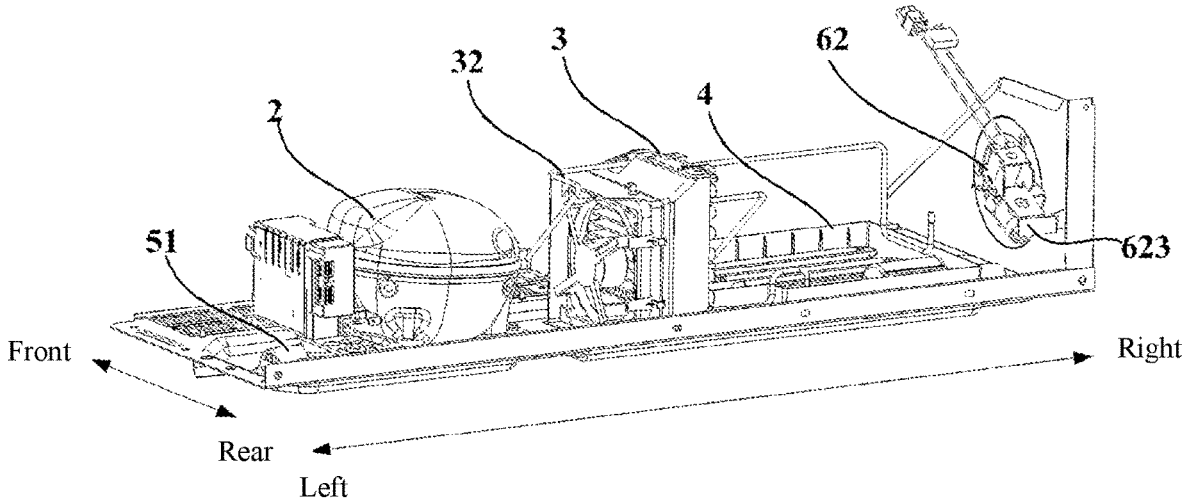
FIG. 10 is a schematic diagram showing an installation of an ice water valve in the installation space using a second mating structure, according to some embodiments of present application.
Figure 11:
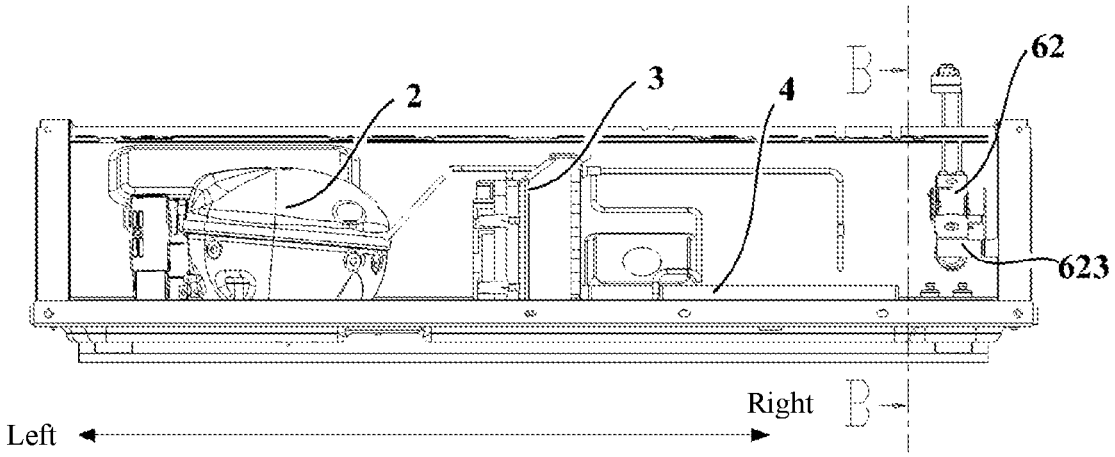
FIG. 11 is a schematic diagram of the structure shown in FIG. 10 from another angle.
Figure 12:
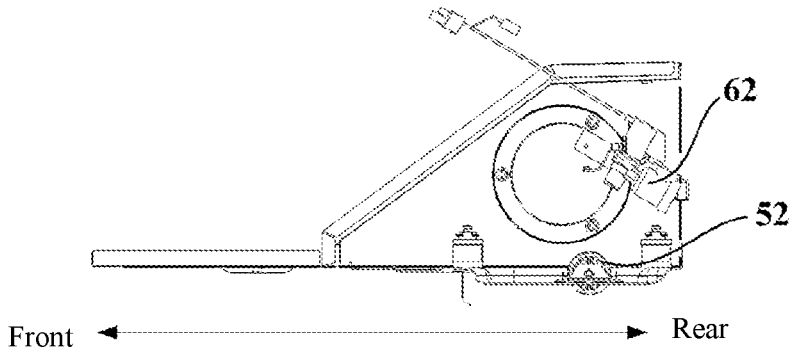
FIG. 12 is a schematic cross-sectional view taken along line B-B in FIG. 11.

FIG. 10 is a schematic diagram according to some embodiments of present application showing an ice water valve 62 installed in the installation space 123 using the second mating structure; FIG. 11 is a schematic diagram of the structure shown in FIG. 10 from another angle; FIG. 12 is a schematic cross-sectional view taken along line B-B in FIG. 11.

The second mating structure includes positioning slots and fixing holes located on the sidewall of the installation space, which are not visible in the diagram due to being obscured by the right sidewall. An auxiliary functional component installed on the second mating structure can be an ice water valve 62. The ice water valve 62 is connected to the second mating structure through a fixed frame 623.

The fixed frame 623 is configured to position the ice water valve 62 in a center of the installation space 123, maintaining specified distances from the sidewall, top wall, bottom wall of the installation space, and the evaporating tray. For example, a horizontal length of the ice water valve 62 is 49 mm, for a cabinet with the horizontal width of the bottom plate of the heat dissipation compartment 12 being 820 mm, the horizontal length of the ice water valve occupies 55.7% of the total horizontal size of the installation space 123.

In terms of height, a height of the ice water valve 62 is 89 mm, and a total height of the installation space 123 is 165 mm, so that a proportion of the height of the ice water valve 62 is 53.9% of the total height of the installation space. Those skilled in the art can flexibly configure the specific dimensions based on component sizes, refrigerator specifications, etc., such as adjusting proportionally or within a certain range.

The fixed frame 623 extends from the right sidewall toward the installation space 123, creating a gap between the ice water valve 62 and the right sidewall, and the fixed frame 623 can be attached to the cabinet 1 through screws and positioning posts in coordination with the fixing holes and the positioning slots.

The ice water valve 62 can be used to control a water flow of an ice maker inside the refrigerator.

The ice water valve 62 and the vacuum pump 61 can be optionally installed to provide differentiated auxiliary functions, meeting different customers' needs.

The specific dimensions mentioned are results of layout for a refrigerator with the horizontal width of the bottom plate of the heat dissipation compartment 12 being 820 mm. In practice, a person skilled in the art can proportionally adjust the layout based on the technical concept of these embodiments and the size requirements.

From the description above, a person skilled in the art can understand that the heat dissipation compartment 12 reserves the installation space 123 on the side far from the duct assembly 3 relative to the evaporating tray 4, equipped with one or more mating structures for installing auxiliary functional components. By optimizing the device layout within the confined space of the heat dissipation compartment 12, it achieves the purpose of reserving installation space. This provides installation space for extending functionalities of different refrigerator models, enhancing product competitiveness and saving development costs.

Thus, the technical solutions of present application have been described through several embodiments, but it is understood by a person skilled in the art that the scope of protection of present application is not limited to these specific embodiments. Without departing from the principles of present application, a person skilled in the art can split and combine these technical solutions or make equivalent changes or substitutions to the related technical features. Any changes, equivalent replacements, or improvements made within the conceptual framework and/or principles of present application fall within the scope of protection of present application.

What is claimed is:

1. A refrigerator, comprising:

a cabinet defining a storage chamber, with a heat dissipation compartment set at a rear bottom of the cabinet;

a compressor, a duct assembly, and an evaporating tray sequentially arranged within the heat dissipation compartment along a horizontal direction of the cabinet, wherein a heat dissipating fan is installed on a first side of the duct assembly facing the compressor, a condenser is installed on a second side of the duct assembly facing the evaporating tray, and the heat dissipation compartment reserves an installation space on a third side of the evaporating tray away from the duct assembly, the installation space is equipped with one or more mating structures, each of which is used to install an auxiliary functional component;

the mating structures comprise a first mating structure set on a bottom plate of the heat dissipation compartment, the first mating structure comprises multiple fixing holes and fixing columns corresponding one-to-one with the fixing holes; and the auxiliary functional component mounted on the first mating structure comprises a vacuum pump, which is mounted on the fixing columns.

2. The refrigerator of claim 1, wherein a length of the installation space along the horizontal direction of the refrigerator is greater than or equal to 10% of a length of the heat dissipation compartment along the horizontal direction of the refrigerator.

3. The refrigerator of claim 2, wherein the mating structures comprise a second mating structure set on a sidewall of the installation space opposite the duct assembly.

4. The refrigerator of claim 3, wherein the bottom plate of the heat dissipation compartment on a fourth side opposite the compressor relative to the duct assembly is equipped with a first roller; the bottom plate of the heat dissipation compartment is equipped with a second roller; the first mating structure surrounds the second roller.

5. The refrigerator of claim 3, wherein the second mating structure comprises a positioning slot and fixing holes located on the sidewall of the installation space;

the auxiliary functional component mounted on the second mating structure comprises an ice water valve, which is connected to the second mating structure through a fixed frame.

6. The refrigerator of claim 5, wherein the fixed frame is configured to position the ice water valve in a center of the installation space, maintaining specified distances from the sidewall of the installation space opposite the duct assembly, a top wall, and a bottom wall of the installation space, and the evaporating tray.

7. The refrigerator of claim 1, wherein heights of the fixing columns are configured such that a first height from a bottom of the second roller to the bottom plate of the heat dissipation compartment is less than a second height from a top of the second roller to a bottom of the vacuum pump.

8. The refrigerator of claim 7, wherein a top of the vacuum pump is spaced at a gap from a top wall of the installation space.

9. The refrigerator of claim 8, wherein a horizontal distance from the evaporating tray to a side wall of the vacuum pump is less than a horizontal distance from the vacuum pump to the sidewall of the installation space opposite the duct assembly.

10. The refrigerator of claim 7, wherein a horizontal distance from the evaporating tray to a side wall of the vacuum pump is less than a horizontal distance from the vacuum pump to the sidewall of the installation space opposite the duct assembly.

11. The refrigerator of claim 1, wherein a horizontal distance from the evaporating tray to a side wall of the vacuum pump is less than a horizontal distance from the vacuum pump to the sidewall of the installation space.

12. A refrigerator, comprising:

a cabinet defining a storage chamber, with a heat dissipation compartment set at a rear bottom of the cabinet;

a compressor, a duct assembly, and an evaporating tray sequentially arranged within the heat dissipation compartment along a horizontal direction of the cabinet, wherein a heat dissipating fan is installed on a first side of the duct assembly facing the compressor, a condenser is installed on a second side of the duct assembly facing the evaporating tray, and the heat dissipation compartment reserves an installation space on a third side of the evaporating tray away from the duct assembly, the installation space is equipped with one or more mating structures, each of which is used to install an auxiliary functional component;

the mating structures comprise a first mating structure set on a sidewall of the installation space opposite the duct assembly, the first mating structure comprises a positioning slot and fixing holes located on the sidewall of the installation space opposite the duct assembly;

the auxiliary functional component mounted on the first mating structure comprises an ice water valve, which is connected to the first mating structure through a fixed frame.

13. The refrigerator of claim 12, wherein the mating structures comprise a second mating structure set on a bottom plate of the installation space.

14. The refrigerator of claim 13, wherein the bottom plate of the heat dissipation compartment on one side opposite the compressor relative to the duct assembly is equipped with a first roller; the bottom plate of the heat dissipation compartment is equipped with a second roller; the second mating structure surrounds the second roller.

15. The refrigerator of claim 14, wherein the second mating structure comprises multiple fixing holes and fixing columns corresponding one-to-one with the fixing holes; and the auxiliary functional component mounted on the second mating structure comprises a vacuum pump, which is mounted on the fixing columns.

16. The refrigerator of claim 14, wherein a horizontal distance from the evaporating tray to a side wall of the vacuum pump is less than a horizontal distance from the vacuum pump to the sidewall of the installation space opposite the duct assembly.

17. The refrigerator of claim 13, wherein the fixed frame is configured to position the ice water valve in a center of the installation space, maintaining specified distances from the sidewall of the installation space opposite the duct assembly, a top wall, and a bottom wall of the installation space, and the evaporating tray.

* * * * *